US006644037B2

(12) United States Patent
Busick et al.

(10) Patent No.: US 6,644,037 B2
(45) Date of Patent: Nov. 11, 2003

(54) THERMOELECTRIC BEVERAGE COOLER

(75) Inventors: Louis M. Busick, Columbus, OH (US); Stephen W. Wharton, Columbus, OH (US); Stephen J. Sabin, Ballina (IE); Declan L. Coyle, Ballina (IE)

(73) Assignee: Oasis Corporation, Columbus, OH (US)

( * ) Notice: Subject to any disclaimer, the term of this patent is extended or adjusted under 35 U.S.C. 154(b) by 0 days.

(21) Appl. No.: 10/255,554

(22) Filed: Sep. 25, 2002

(65) Prior Publication Data

US 2003/0115902 A1 Jun. 26, 2003

Related U.S. Application Data

(60) Provisional application No. 60/325,484, filed on Sep. 26, 2001.

(51) Int. Cl.[7] ..... F25B 21/02
(52) U.S. Cl. ..... 62/3.64; 62/389
(58) Field of Search ..... 62/3.2, 3.3, 3.64, 62/385, 395, 457.9

(56) References Cited

U.S. PATENT DOCUMENTS 2,657,554 A * 11/1953 Hull ..... 62/141
4,622,822 A * 11/1986 Beitner ..... 62/3
5,072,590 A 12/1991 Burrows
5,355,678 A * 10/1994 Beitner ..... 62/3.2
6,003,318 A 12/1999 Busick et al.
6,119,462 A 9/2000 Busick et al.
6,532,746 B1 * 3/2003 Bloom et al. ..... 62/3.7

* cited by examiner

*Primary Examiner*—Melvin Jones
(74) *Attorney, Agent, or Firm*—Kelly Bauersfeld Lowry & Kelley, LLP

(57) ABSTRACT

A beverage cooler is provided with an improved thermoelectric chiller unit for chilling a supply of water or other selected beverage within a cooler reservoir. The improved thermoelectric chiller unit includes a thermoelectric heat transfer module captured by a spring mount with substantially uniform pressure distribution between a chiller probe for chilling the water within the cooler reservoir, and a heat exchanger for dissipating heat drawn from the chilled water. The cooler reservoir has a faucet mounted thereon for on-demand dispensing of the water, and is mounted as a removable unit within a cooler housing with a bottom wall of the reservoir defining an inverted cup-shaped receptacle for close slide-fit reception of the chiller probe.

29 Claims, 9 Drawing Sheets

FIG. 12
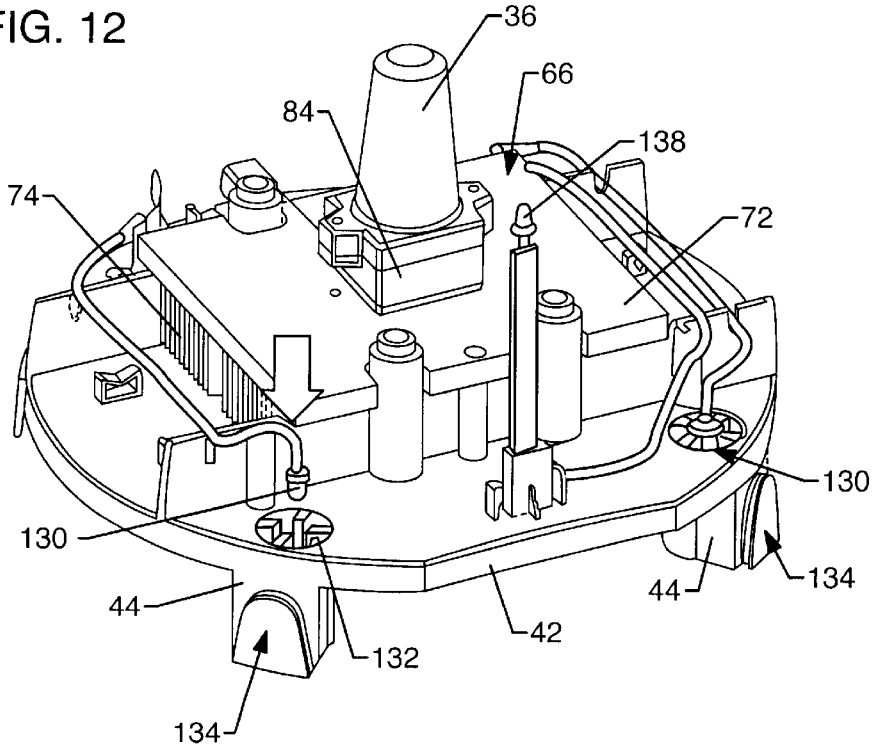
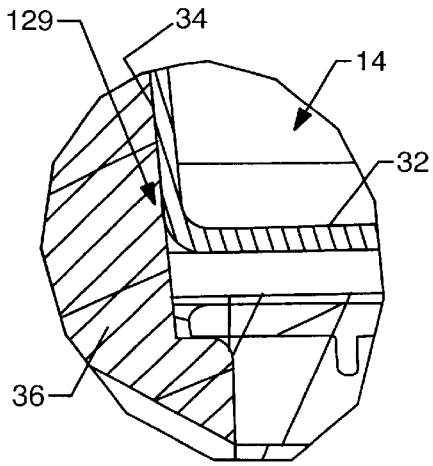
FIG. 13
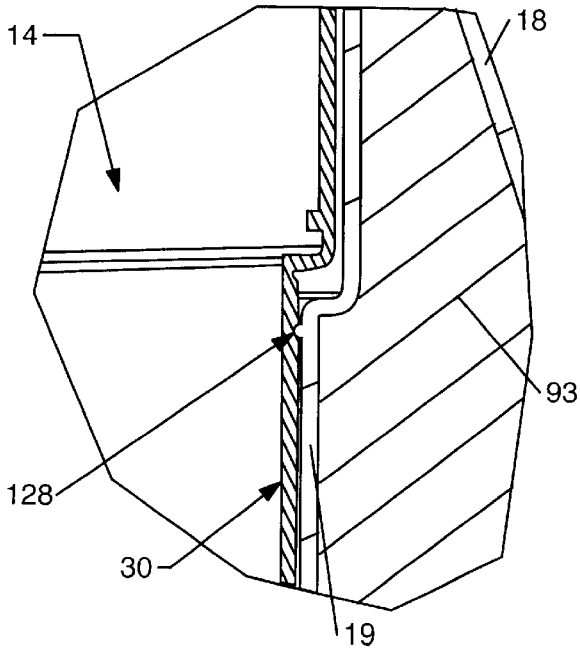
FIG. 14

THERMOELECTRIC BEVERAGE COOLER

The application claims the benefit of copending U.S. Provisional Application No. 60/325,484, filed Sep. 26, 2001.

BACKGROUND OF THE INVENTION

This invention relates generally to improvements in devices and systems for chilling a selected beverage such as water or the like. More particularly, this invention relates to improvements in a beverage or water cooler of the type equipped with a compact thermoelectric heat transfer module for quietly and efficiently chilling the liquid contained within a cooler reservoir.

Water coolers are well known in the art for containing a supply of a selected beverage such as relatively purified water in a convenient manner and location ready for substantially immediate dispensing and use. Such water coolers commonly include an upwardly open reservoir adapted to receive and support a water bottle of typically three to five gallon capacity in an inverted orientation such that bottled water may flow downwardly into the cooler reservoir. A faucet or spigot on the front of a cooler housing is operable at any time for on-demand dispensing of the water in selected amounts. Such bottled water coolers are widely used to provide a clean and safe source of drinking water, especially in areas wherein the local water supply may or is suspected to contain undesired levels of contaminants. In one alternative configuration, the upper end of the cooler reservoir is normally closed by a lid which can be opened as needed for periodically replenishing the reservoir water by pour-in addition of water thereto. In other known alternative water cooler designs, the cooler reservoir is replenished by connection to a water supply line, and may include water filtration and/or purification means such as a reverse osmosis unit for purifying water supplied to the cooler reservoir.

In many water coolers of the type described above, it is desirable to chill or refrigerate the water or other beverage within the cooler reservoir to a relatively low, refreshing temperature. However, refrigeration equipment for such water coolers has typically comprised conventional compressor-type mechanical refrigeration systems which undesirably increase the overall cost, complexity, size, operational noise level, and power consumption requirements of the water cooler. Alternative cooling system proposals have suggested the use of relatively compact and quiet thermoelectric heat transfer modules, such as the systems shown and described in U.S. Pat. Nos. 5,072,590; 6,003,318; and 6,119,462. In such proposals, a thermoelectric module is mounted with a cold side thereof disposed in heat transfer relation with water in the cooler reservoir, and a hot side associated with a heat sink for dissipating heat drawn from the water. A cooling fan is normally provided to circulate air over the heat sink for improved heat transfer efficiency.

In such thermoelectric chiller systems, the thermoelectric heat transfer module is normally sandwiched in clamped relation between a chiller probe or other cold surface structure disposed in heat transfer relation with the beverage or water to be chilled, and a fin-type heat sink for dissipating the collected heat energy. However, during normal operation, the heat transfer module is exposed to significant thermal cycling with resultant expansion and contraction which can reduce the clamping force applied thereto and correspondingly reduce the thermal coupling efficiency with respect to the chiller probe and heat sink.

The present invention provides an improved thermoelectric beverage cooler including an improved mounting arrangement for supporting a thermoelectric heat transfer module with substantially uniform pressure distribution between a chiller probe and a heat sink.

SUMMARY OF THE INVENTION

In accordance with the invention, a beverage cooler is provided with an improved thermoelectric chiller unit for chilling a supply of water or other selected beverage within a cooler reservoir. The improved thermoelectric chiller unit includes a thermoelectric heat transfer module captured by a spring mount with substantially uniform pressure distribution between a chiller probe for chilling the water within the cooler reservoir, and a heat exchanger or heat sink for dissipating heat drawn from the chilled water.

In the preferred form, the thermoelectric heat transfer module comprises a solid state chip having semiconductor materials with dissimilar characteristics (P-type and N-type materials) connected electrically in series and thermally in parallel, such as the heat transfer module available from Borg-Warner Corporation under model designation 920-31. This heat transfer module is sandwiched between a chiller probe and a heat sink, both formed from a selected material having relatively high thermal conductivity, such as aluminum or the like. Fasteners such as a pair of screws are provided to interconnect the chiller probe and heat sink, with the thermoelectric heat transfer module sandwiched in clamped relation therebetween. In accordance with one aspect of the invention, the fasteners are passed through the opposite ends of an elongated spring strip having a central resilient spring segment extending toward and bearing against one of the clamping structures, such as the heat sink in the preferred form of the invention. This spring strip uniformly maintains the components in tightly clamped relation, while substantially uniformly distributing the clamping forces across the surface area of the thermoelectric heat transfer module to reduce or eliminate undesirable module cracking during use.

In accordance with other aspects of the invention, the cooler reservoir has an inverted and generally cup-shaped receptacle formed in a bottom wall thereof for close slide-fit reception of the chiller probe when the reservoir is installed into a cooler housing. An upwardly open insulation shell is provided within the cooler housing for nested reception of the cooler reservoir to insulate the reservoir contents. A faucet is mounted on a front side of the reservoir for use in dispensing the reservoir contents, wherein this faucet is exposed for access at a front side of a cooler housing through aligned gaps formed in the cooler housing and the insulation shell. The reservoir with faucet thereon is removable as a unit from the cooler housing.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 12 is a perspective view illustrating the thermoelectric chiller unit mounted on a housing base frame, and including light means;

FIG. 13 is an enlarged fragmented perspective view corresponding with the encircled region 13 of FIG. 4; and FIG. 14 is an enlarged fragmented perspective view corresponding with the encircled region 14 of FIG. 4.

DETAILED DESCRIPTION OF THE PREFERRED EMBODIMENT

Figure 1:
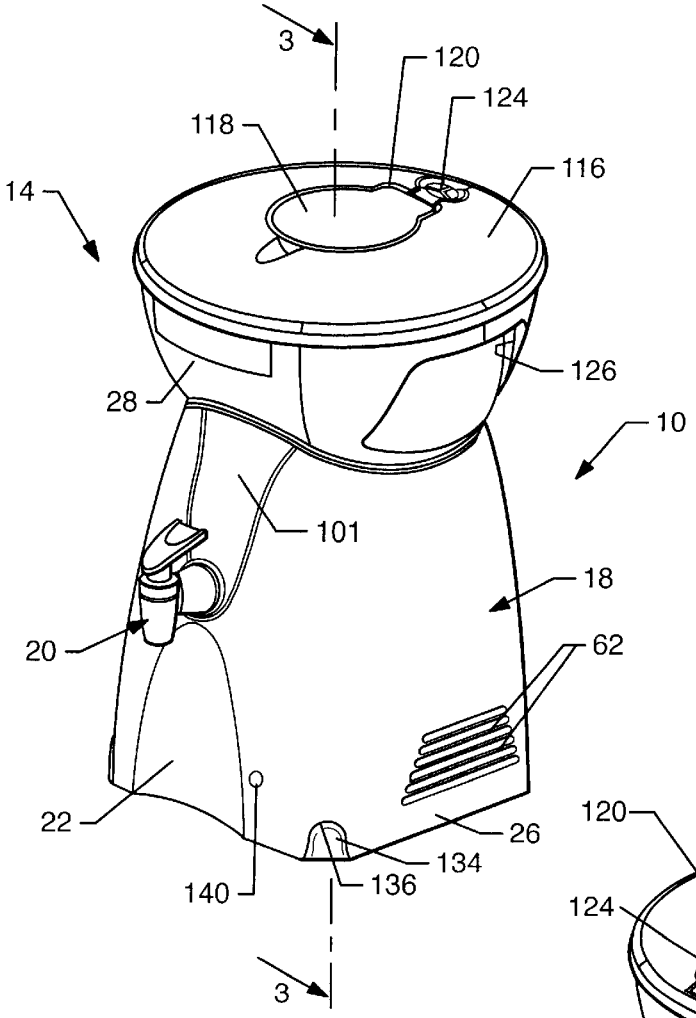
FIG. 1 is a front perspective view of a thermoelectric beverage cooler embodying the novel features of the invention.

As shown in the exemplary drawings, a beverage cooler referred to generally by the reference numeral 10 in FIGS. 1–4 includes a thermoelectric heat transfer module 12 (FIGS. 3–4) for chilling a selected beverage such as water or the like within a cooler reservoir 14. The thermoelectric heat transfer module 12 is provided as part of a relatively compact thermoelectric chiller unit or subassembly 16 (FIGS. 5 and 8–11) adapted for quick and easy mounting within a housing 18 for the cooler 10. In addition, the cooler reservoir 14 has a faucet 20 mounted thereon and exposed at a front side of the cooler housing 18 for on-demand dispensing of the reservoir contents. This reservoir 14 including the faucet 20 is quickly and easily removable as a unit from the cooler housing.

Figure 2:
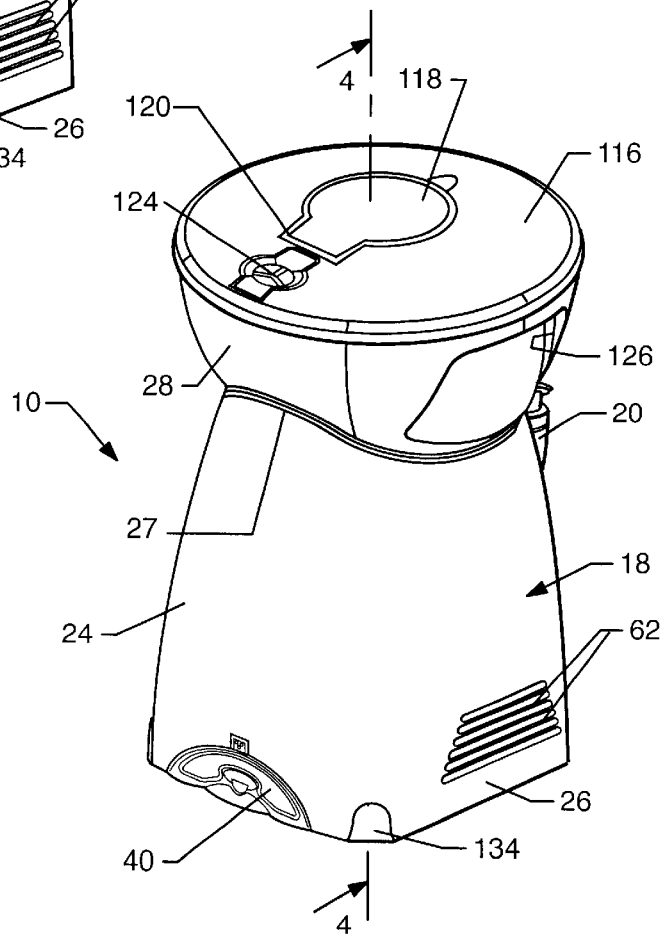
FIG. 2 is a rear perspective view of the beverage cooler.
Figure 3:
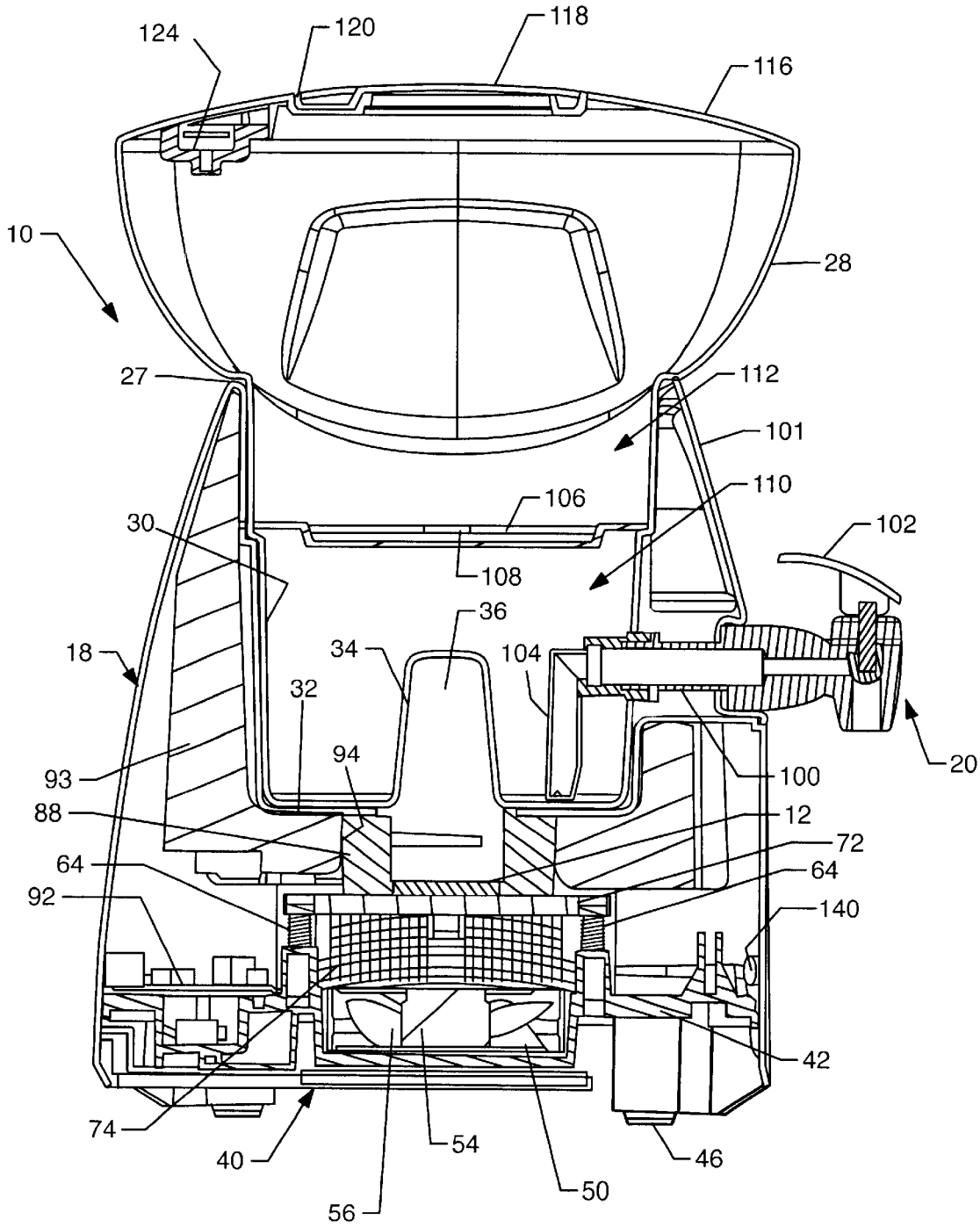
FIG. 3 is an enlarged vertical sectional view taken generally on the line 3—3 of FIG. 1.
Figure 4:
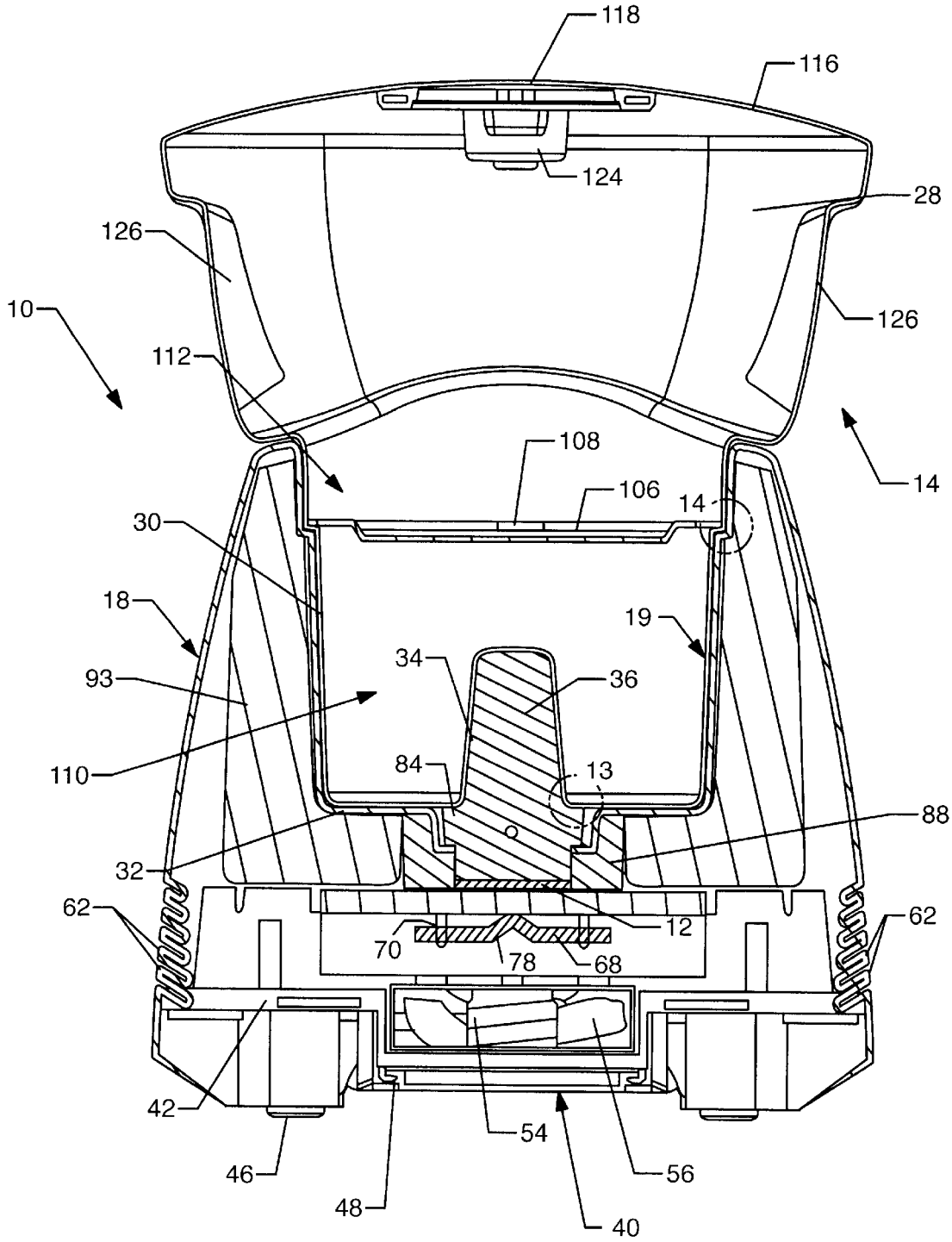
FIG. 4 is an enlarged vertical sectional view taken generally on the line 4—4 of FIG. 2.
Figure 6:
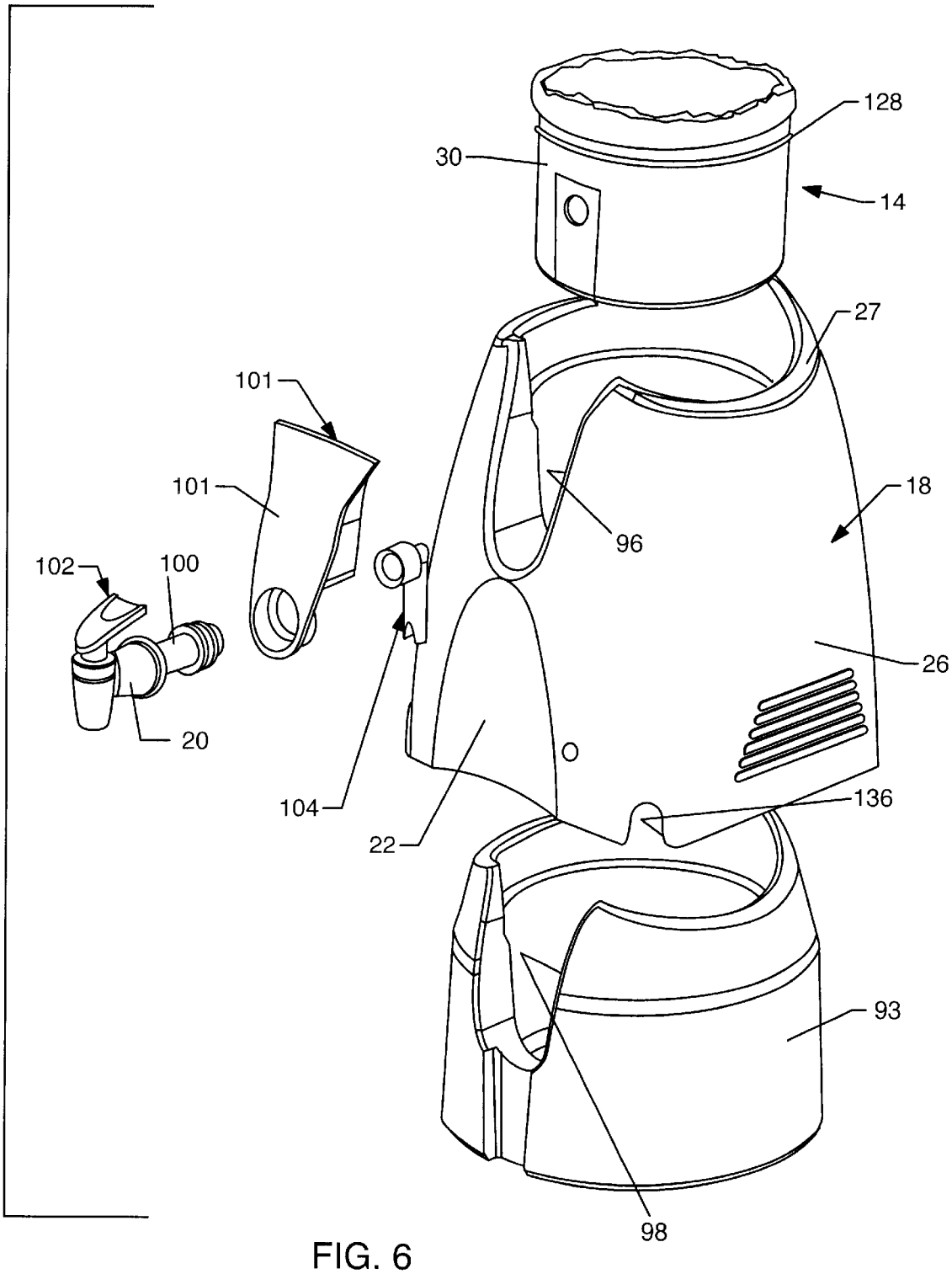
FIG. 6 is an exploded perspective view illustrating assembly of a removable beverage reservoir with a cooler housing and associated insulation.
Figure 7:
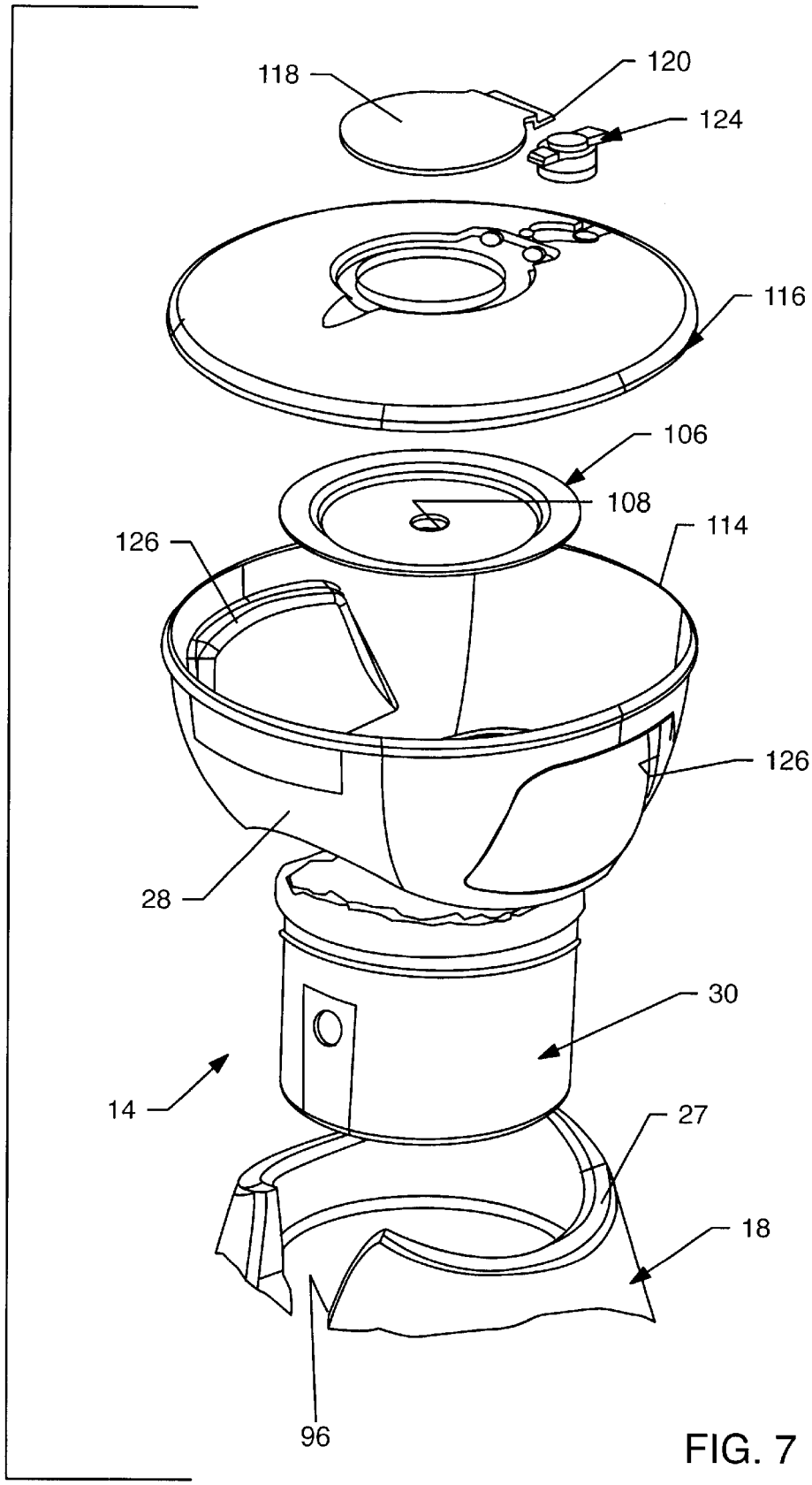
FIG. 7 is an exploded perspective view depicting assembly of an exemplary lid and filter with the removable reservoir.

The beverage cooler 10 depicted in the illustrative drawings comprises a countertop type cooler having the housing 18 of compact size and shape suitable for placement onto a countertop (not shown). As viewed generally in FIGS. 1, 2 and 6, the housing 18 has a generally rectangular or square-shaped base footprint which extends upwardly from a lower edge to define a front wall 22, a rear wall 24, and a pair of side walls 26 joined therebetween. These housing walls 22, 24 and 26 are shown to curve and converge slightly inwardly from bottom to top, and collectively define a contoured upper edge 27 designed for seated and stable support of an upper bowl-shaped portion 28 of the beverage reservoir 14. As shown in FIGS. 3, 4 and 7, this upper bowl-shaped reservoir portion 28 is formed at the upper extent of a generally cylindrical lower reservoir portion 30 having a closed bottom wall 32 interrupted by a centrally formed upwardly extending receptacle 34 of generally inverted cup-shaped configuration (FIGS. 3 and 4).

The reservoir 14 is designed for removable mounting into the upwardly open housing 18, with the receptacle 34 in the reservoir bottom wall 32 mounted over an upwardly extending chiller probe 36 forming a portion of the thermoelectric chiller unit 16 whereby the chiller probe 36 is in thermal communication with the reservoir contents as will be described in more detail. In this regard, the thermoelectric chiller unit 16 generally comprises a pre-assembled unit installed within the cooler housing at a lower or bottom end thereof. As shown best in FIG. 5, the thermoelectric chiller unit 16 is mounted in overlying relation to a fan unit 38, which is in turn mounted over a removable filter tray 40.

Figure 5:
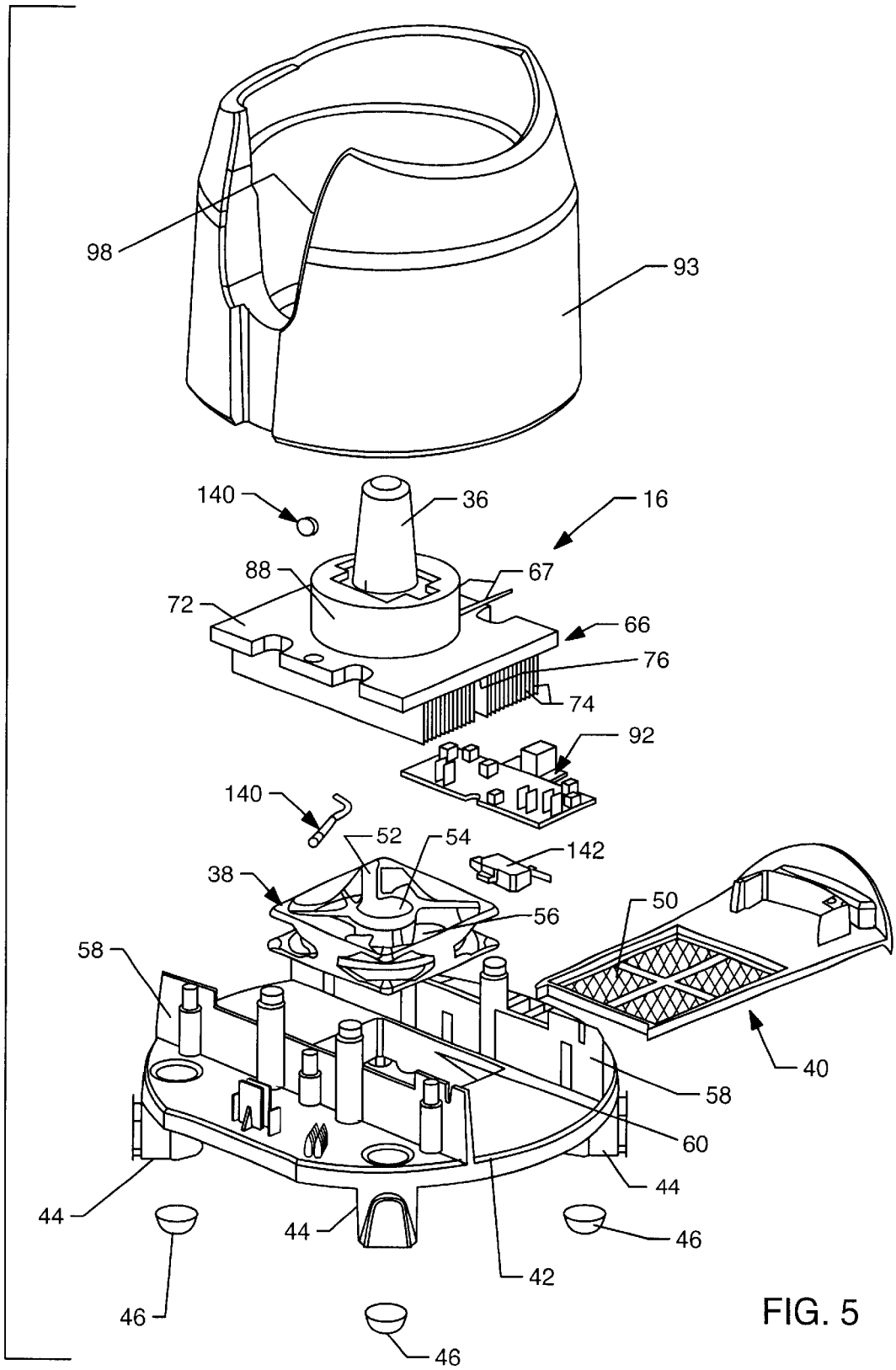
FIG. 5 is an exploded perspective view showing assembly of a lower portion of the beverage cooler.

More particularly, FIG. 5 illustrates a lower base frame 42 having a size and shape for mounting within a lower region of the cooler housing 18 by means of screws (not shown) or the like. This base frame 42 includes four downwardly protruding feet 44 disposed at the four corners of the housing footprint, wherein cushioned pads 46 may be conveniently mounted to the bottoms of these feet 44. A lower slot 48 (FIG. 4) is defined at the underside of the base frame 42 for lateral slide-fit removable mounting of the filter tray 40 having a selected porous filter media 50 (FIG. 5) carried thereon. This filter tray 40 is removably mounted from the rear wall 24 of the cooler housing 18 (FIG. 2) in a manner shown and described in more detail in U.S. Pat. No. 6,003,318, which is incorporated by reference herein.

The fan unit 38 comprises a compact and generally pancake-shaped fan housing 52 with a low profile drive motor 54 and related fan impeller 56 mounted therein (FIGS. 3–5). The fan unit 38 is mounted onto the upper side of the base frame 42 by means of screws (not shown) or the like in a position between a pair of upwardly extending frame ribs 58 and overlying an air inlet port 60 formed centrally in the base frame 42 (FIG. 5). In operation, the fan impeller 56 draws ambient air from beneath the base frame 42 upwardly through the filter media 50 and further through the air inlet port 60 into heat transfer relation with the thermoelectric chiller unit 16, as will be described. This cooling air flow is conveniently exhausted from the cooler housing 18 via air vents 62 formed in the housing side walls 26 near the lower ends thereof (FIG. 2).

The base frame 42 may also support an indicator light system for providing a visual indication that the filter media 50 on the filter tray 40 needs to be cleaned or changed to maintain optimum air flow circulation. In this regard, a filter indicator light 140 (FIGS. 1, 3 and 5) is mounted for viewing through a small port formed in the housing front wall 22. In a preferred form, this filter light 140 is associated with a switch 142 (FIG. 5) which responds to slide-in insertion placement of the filter tray 40 to initiate a clock (which may be incorporated into a controller 92, as will be described in more detail) for energizing the filter light 140 at the conclusion of a predetermined time interval, such as about 30 days. The specific construction and operation of this filter change indicator light system is shown and described in more detail in copending Provisional Appln. No. 60/282,362, filed Apr. 7, 2001, and the related Ser. No. 10/114,861, filed Apr. 2, 2002, which are incorporated by reference herein.

Figure 8:
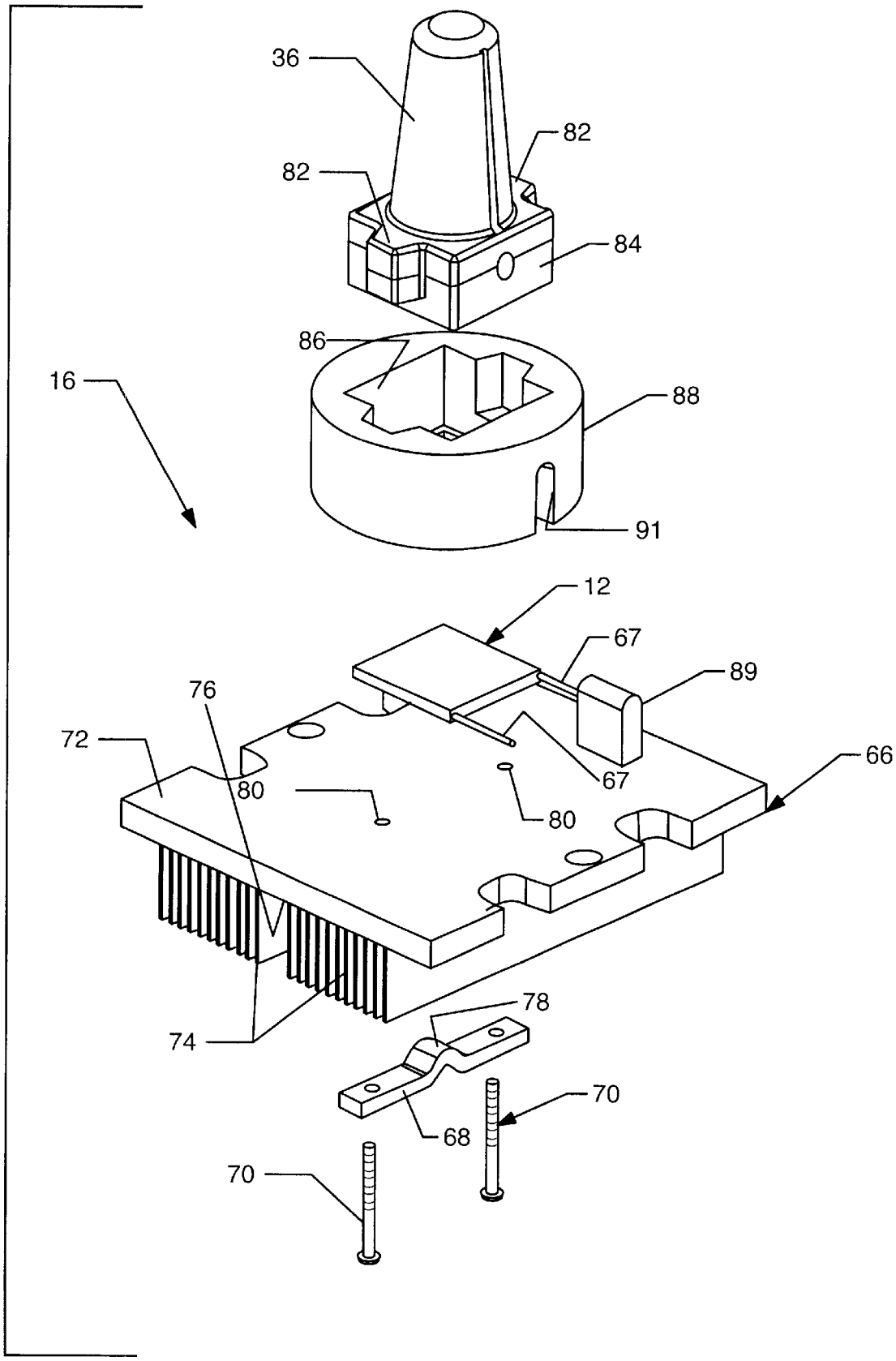
FIG. 8 is an exploded perspective view showing assembly of a thermoelectric chiller unit.
Figure 9:
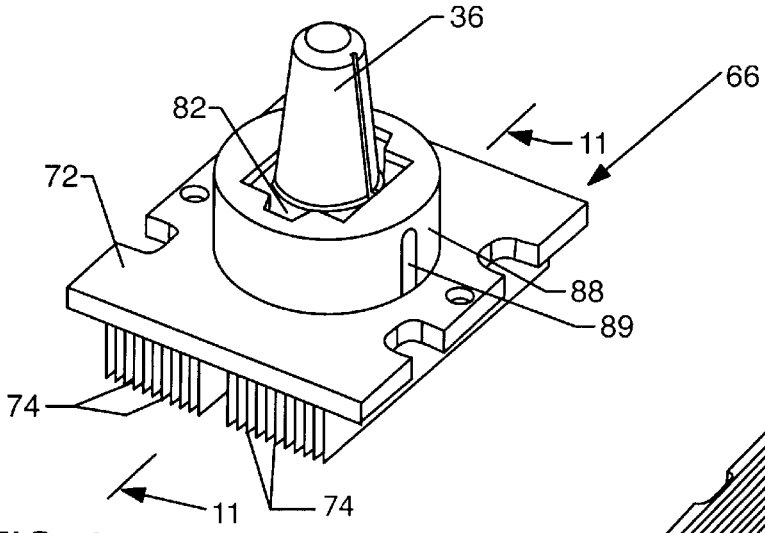
FIG. 9 is a top perspective view showing the thermoelectric chiller unit in assembled form.
Figure 10:
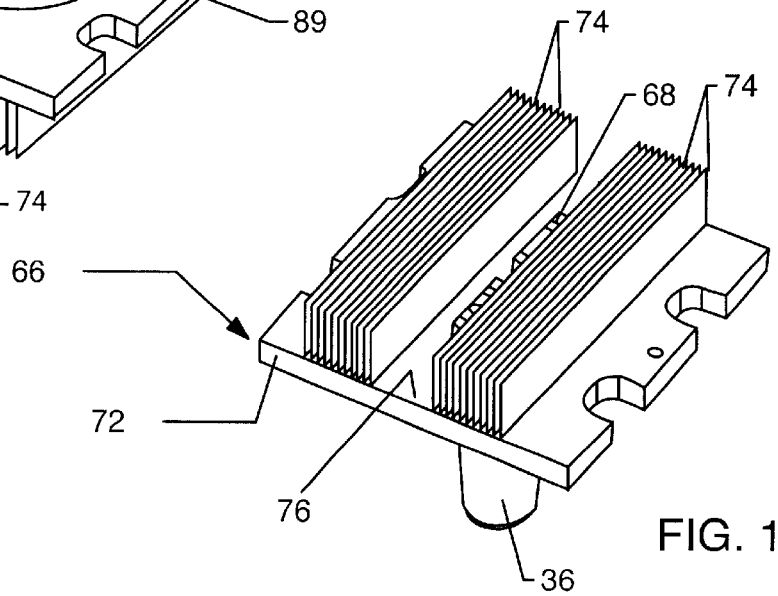
FIG. 10 is a bottom perspective view of the thermoelectric chiller unit in assembled form.

The thermoelectric chiller unit 16 is installed onto the base frame 42 by screws 64 (FIG. 3) or the like in a position directly overlying the fan unit 38. As shown best in FIGS. 5 and 8–11, the chiller unit 16 comprises the thermoelectric heat transfer module 12 clamped in sandwiched relation between the overlying chiller probe 36 and an underlying heat exchanger or heat sink 66. This thermoelectric heat transfer module 12 comprises a relatively thin and generally flat-sided structure designed for transferring heat energy from a cold side to a hot side thereof, or vice versa, depending upon the polarity of a dc electrical signal connected thereto via a pair of conductors 67 (FIG. 8). One such heat transfer module is available form Borg-Warner Corporation under model designation 920-31, and employs semiconductor materials with dissimilar characteristics (P-type and N-type materials) connected electrically in series and thermally in parallel. In accordance with one primary aspect of the invention, the heat transfer module 12 is clamped with substantially uniform distribution of clamping forces by means of a spring mount including an elongated spring clip or strip 68 and a pair of fasteners 70 such as screws.

More specifically, FIG. 8 shows the heat sink 66 to include a generally planar backing plate 72 joined to an array of downwardly projecting heat dissipation fins 74 disposed to present an extended heat transfer surface area exposed to the cooling air flow circulation produced through the lower region of the housing 18 by the fan unit 38. These fins 74 are interrupted by a transversely extending and downwardly open slot 76. The spring clip 68 has a size and shape to fit into this slot 76, with a central spring segment 78 offset from the strip plane and protruding upwardly from a central region of the spring strip 68 in a direction toward the underside of the heat sink backing plate 72 for bearing engagement therewith. The fasteners 70 are passed upwardly through the opposite ends of the spring strip 68, and further upwardly through a pair of ports 80 formed in the backing plate 72 on opposite sides of the thermoelectric module 12.

Figure 11:
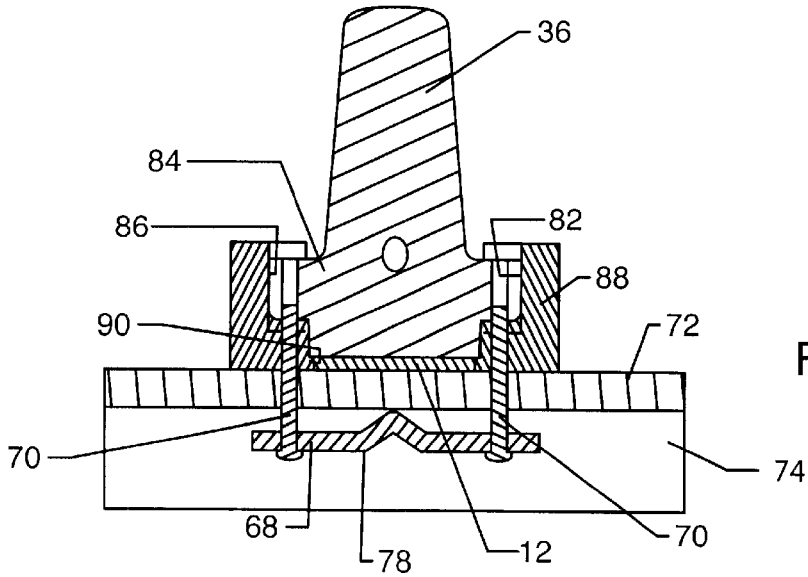
FIG. 11 is an enlarged vertical sectional view taken generally on the line 11—11 of FIG. 9.

The fasteners 70 are threadably engaged into a corresponding pair of threaded bores 82 formed in a pair of outwardly radiating wings 84 at a base or lower end of the chiller probe 36. In this regard, FIGS. 5 and 8–11 show the winged base of the chiller probe 36 seated within an upwardly open and matingly shaped pocket 86 formed in a mounting collar 88 of thermal insulation material. This collar 88 has a generally cylindrical shape, including a generally rectangular internal passage 90 for matingly receiving and positioning the thermoelectric module 12 (FIG. 11). The mounting collar 88 is seated on the upper side of the heat sink backing plate 72 by means of the fasteners 70, with a tab 89 upstanding on the backing plate 72 and received into a mating channel 91 (FIG. 8) for rotationally setting the collar 88 and the associated chiller probe 36 relative to the heat sink 66.

With this construction, the thermoelectric heat transfer module 12 is clamped in stacked relation between an upper side of the heat sink backing plate 72, and a lower side of the chiller probe 36. This clamping action is achieved by advancing the fasteners 70 through the opposite ends of the spring clip 68, with the central spring segment 78 bearing against the underside of the heat sink backing plate 72. As shown best in FIG. 11, this causes the opposite ends of the spring clip 68 to springably deform toward the backing plate, for purposes of drawing the chiller probe 36 downward into tightly clamped relation with the module 12. Importantly, this spring mount arrangement applies substantially uniformly distributed clamping forces to the module 12, irrespective of nonuniform relative advancement of the two fasteners 70. The presence of such uniformly distributed clamping forces beneficially reduces or eliminates thermal-induced cracking and resultant failure module 12, and additionally maintains and assures efficient thermal contact between the sandwiched components by eliminating air gaps between the module 12 and the overlying chiller probe base 84 and the underlying heat sink backing plate 72.

The heat sink 66 and the chiller probe 36 are formed from materials selected for relatively high thermal conductivity, such as aluminum or the like. With this construction, and by appropriately connecting a dc signal to the thermoelectric heat transfer module 12, the module functions to draw or extract thermal energy from the chiller probe 36 at the module cold side and to transfer the extracted heat energy to the heat sink 66 at the module hot side. The controller 92 (FIG. 5) is mounted onto the base frame 42 for appropriately supplying this dc signal to the module 12, as well as providing and regulating electrical power to other cooler components, as previously described. When the chiller probe 36 is in thermal communication with the reservoir in contact with the inverted cup-shaped receptacle 34 which is in turn in contact with the reservoir contents, the chiller unit 16 thus operates to chill the beverage within the reservoir 14 to a pleasing and refreshing temperature.

As previously described, the reservoir 14 is configured for seated reception into the cooler housing 18, with the bottom wall receptacle 34 fitted over the upstanding chiller probe 36 of the thermoelectric chiller unit 16. In this position, the chiller probe 36 is in thermal communication with the beverage contained within the reservoir to chill the reservoir contents. As shown in FIGS. 3, 4 and 6, the lower portion 30 of the reservoir 14 is nestably seated within the housing 18, and an insulation shell 93 formed from a selected insulative material such as stryofoam or the like is slidably fitted upwardly into the housing 18 interior prior to installation of the lower base frame 42. As shown, this insulation shell 93 conveniently rests upon the upstanding frame ribs 58, and has a central opening 94 in a bottom wall thereof for slide-fit reception of the mounting collar 88 of the chiller unit 16.

An upwardly open central gap 96 is formed in the front wall 22 of the cooler housing 18, in alignment with a correspondingly shaped central gap 98 formed in the insulation shell 93, as viewed in FIGS. 3 and 5–7. These gaps 96, 98 in the housing structure accommodate passage of a dispense conduit 100 having an inboard end suitably connected to the reservoir lower portion 30, and an outboard end carrying the dispensing faucet 20. A trim panel 101 is carried on the dispense conduit 100 for visually closing the gap 96 in the housing 18. Appropriate manipulation of a spring-loaded faucet handle 102 results in dispensing of the chilled reservoir contents. In this regard, the inboard end of the dispense conduit 100 may be coupled to a short dip tube 104 which extends downwardly to a point near the bottom wall 32 of the reservoir 14. With this construction, the dispensed beverage comprises a portion of the reservoir contents disposed at or near the chiller probe 36 for optimal chilling prior to dispensing. An internal baffle disk 106 (FIGS. 3–4 and 7) having a central aperture 108 therein may also be provided to subdivide the reservoir interior into a chilled lower chamber 110 (FIGS. 3–4) and an unchilled upper chamber 112, so that the refrigeration capacity of the chiller unit 16 is focused upon a portion of the reservoir contents (within the lower chamber 110) for substantially optimized beverage chilling prior to individual dispense events. In addition, the chiller unit 16 can be regulated by the controller 92 for producing an ice block (not shown) surrounding the receptacle 34 within the lower chamber 110 for optimized beverage chilling.

An upper rim 114 (FIG. 7) of the reservoir bowl portion 28 carries a removably mounted cap 116 (FIGS. 1–4 and 7), which preferably includes a peripheral seal engageable with the reservoir rim 114. This cap 116 in turn includes a central lid 118 mounted thereto by a pivot pin 120 or the like for pivoting movement between open and closed positions. A seal may also be provided at the periphery of this lid 118 for engaging the cap 116 in the closed position. With this sealed cap and lid configuration, an air filter 124 is also mounted on the cap 116 for filtering air drawn into the reservoir interior in response to beverage dispensing. When beverage replenishment is desired, the lid 118 can be pivoted upwardly to an open position to permit an additional quantity of the selected beverage to be poured into the reservoir interior.

In accordance with a further aspect of the invention, the reservoir 14 with the faucet 20 mounted thereon is removable as a unit from the cooler housing 18. In this regard, the bowl-shaped upper portion 28 of the reservoir 14 conveniently includes externally accessible, indented hand grips 126 for facilitated manual grasping upon lift-out removal of the reservoir 14 from the cooler housing. Since the faucet 20 remains on the reservoir upon such removal, it is not necessary to drain the contents of the reservoir prior to removal for cleaning or the like. The reservoir 14 is quickly and easily re-installed into the housing 18 by simple drop-in, slide-fit placement with the chiller probe 36 seated into the receptacle 34 at the underside of the reservoir.

To prevent or minimize frost accumulation about the reservoir, a raised seal ring 128 (FIG. 14) may be provided on an interior wall 19 of the housing 18 for engaging the exterior of the reservoir lower portion 30 near the upper margin thereof when the reservoir is installed therein. This seal ring 128 minimizes or prevents ingress of moisture-laden air into the any incremental space between the exterior surfaces of the reservoir portion 30 and the interior surfaces of the housing wall 19 engaged therewith. An additional seal ring 129 (FIG. 13) may also be provided generally at the base of the receptacle 34 for engaging the chiller probe 36 near the lower end thereof to minimize or eliminate air ingress into any residual space between the receptacle and the upstanding chiller probe 36, in the manner disclosed and described in U.S. Pat. No. 5,289,951, which is incorporated by reference herein. Alternately, it will be recognized and appreciated that the seal ring 128 can be formed on the reservoir 14 for engaging the internal housing wall 19, and that the seal ring 129 can be formed on the chiller probe 36 for engaging the interior surface of the receptacle 34, if desired.

Lighting means may also be provided to produce an enhanced cooler appearance, particularly at night or low light level conditions. FIG. 12 shows the thermoelectric chiller unit 16 mounted on the housing base frame 42, with a pair of LED lights 130 fitted into shallow cavities 132 formed within each of the frame feet 44 at the front corners of the cooler housing. These lights 130 are positioned behind translucent or transparent foot panels 134 exposed through recesses 136 (FIG. 6) at the housing corners, when the housing 18 is assembled with the base frame 42. An additional light 138, such as an LED light or light pipe, may also be provided at an upper end of a vertically elongated support post 139 (FIG. 12) or the like, to position the additional light 138 (FIG. 1) behind the trim panel 101 of translucent or transparent construction. These lights 130 and 138 provide externally visible illumination through the associated overlying translucent or transparent panels to provide an attractive cooler appearance, and further to provide sufficient light for facilitated night-time cooler operation.

A variety of further modifications and improvements in and to the thermoelectric beverage cooler of the present invention will be apparent to those persons skilled in the art. By way of example, it will be recognized and appreciated that alternative reservoir configurations may be used for supporting an inverted water supply bottle of the type and manner of a conventional bottled water cooler. It will also be recognized and understood that the reservoir cap structure may incorporate a filter element for filtering contaminants from a selected beverage such as water poured into the reservoir. Accordingly, no limitation on the invention is intended by way of the foregoing description and accompanying drawings, except as set forth in the appended claims.

What is claimed is:

1. A thermoelectric beverage cooler, comprising:

a cooler housing;

a reservoir mounted within said cooler housing for receiving and storing a supply of a selected beverage; and a thermoelectric chiller unit including a thermoelectric heat transfer module having a hot side and a cold side, and means for transferring thermal energy from said cold side to said hot side;

said chiller unit further including a chiller element in thermal communication with the beverage within said reservoir, a heat sink, and means for clamping said thermoelectric heat transfer module between said chiller element and said heat sink;

said clamping means comprising an elongated spring member having an offset central segment, and fastener means for retaining said chiller element, heat transfer module, and heat sink in a stack with said offset central segment of said spring member presented toward and bearing against one end of the stack to apply a substantially uniformly distributed clamping pressure to said heat transfer module.

2. The beverage cooler of claim 1 wherein said reservoir is removably mounted within said housing.

3. The beverage cooler of claim 1 wherein said chiller element comprises an upstanding chiller probe.

4. The beverage cooler of claim 3 wherein said reservoir includes a bottom wall having a generally inverted cup-shaped receptacle formed therein for slide-fit mounting over said chiller probe.

5. The beverage cooler of claim 4 further including seal means for preventing air ingress into residual space between said chiller probe and said reservoir receptacle, when said reservoir is mounted over said chiller probe.

6. The beverage cooler of claim 1 wherein said heat sink comprises a heat exchanger having a plurality of heat transfer fins.

7. The beverage cooler of claim 1 further including fan means for circulating air flow over said heat sink.

8. The beverage cooler of claim 7 further including filter means for filtering the air flow circulated over said heat sink by said fan means.

9. The beverage cooler of claim 1 wherein said heat sink comprises a generally planar backing plate with a plurality of heat dissipation fins projecting downwardly therefrom, said fins defining a downwardly open slot for receiving said spring member with said offset central segment thereof extending upwardly for bearing engagement with the underside of said backing plate, said fasteners comprising a pair of fasteners coupled to opposite ends of said spring member and extending through said backing plate and connected to said chiller element for compressively sandwiching said heat transfer module between said chiller element and said heat sink.

10. The beverage cooler of claim 1 further including an insulation shell mounted within said housing for removably receiving said reservoir.

11. The beverage cooler of claim 10 further including a beverage dispense faucet mounted on said reservoir, and further wherein said insulation shell and said housing have upwardly open aligned gaps formed therein for receiving said dispense faucet for operative access at a front side of said housing, when said reservoir is mounted within said housing.

12. The beverage cooler of claim 11 further including a trim plate carried by said dispense faucet for substantially closing said gap formed in said housing.

13. The beverage cooler of claim 12 wherein said trim plate is formed from a light transmissive material, and further including illumination means disposed within said housing, behind said trim plate.

14. The beverage cooler of claim 1 further including at least one light transmissive member mounted on said housing, and illumination means disposed within said housing, behind said at least one light transmissive member.

15. The beverage cooler of claim 1 wherein said reservoir includes a generally cylindrical lower portion merging at an upper end thereof with a relatively enlarged, generally bowl-shaped upper portion, said reservoir being removably mounted within said housing, with said bowl-shaped upper portion seated upon and substantially exposed above said housing.

16. The beverage cooler of claim 15 further including insulation means mounted within said housing for removable slide-fit reception of said reservoir, and seal means for substantially preventing air ingress into residual space between said insulation means and said cylindrical lower portion of said reservoir.

17. The beverage cooler of claim 15 wherein said bowl-shaped upper portion of said reservoir further includes at least one indented hand grip.

18. The beverage cooler of claim 1 further including a cap for selectively closing an upper end of said reservoir, said cap having an air filter mounted thereon.

19. A thermoelectric beverage cooler, comprising:

a cooler housing;

a reservoir mounted within said cooler housing for receiving and storing a supply of a selected beverage; and a thermoelectric chiller unit including a thermoelectric heat transfer module having a hot side and a cold side, and means for transferring thermal energy from said cold side to said hot side;

said chiller unit further including a chiller element in thermal communication with the beverage within said reservoir, a heat sink including a generally planar backing plate with a plurality of heat dissipation fins extending downwardly therefrom and cooperatively defining a downwardly open slot, and an elongated spring strip having an upwardly extending offset central segment for bearing engagement with the underside of said backing plate, and fastener means coupled to opposite ends of said spring strip and extending through said backing plate and connected to said chiller element for compressively sandwiching said heat transfer module between said chiller element and said heat sink to apply a substantially uniformly distributed clamping pressure to said heat transfer module.

20. A thermoelectric beverage cooler, comprising:

a cooler housing;

insulation means mounted within said housing and defining an upwardly open insulation shell;

a reservoir for receiving and storing a supply of a selected beverage, said reservoir being removably mounted within said housing in nested relation within said insulation shell;

a dispense faucet mounted on said reservoir;

a thermoelectric chiller unit including a thermoelectric heat transfer module having a hot side and a cold side, and means for transferring thermal energy from said cold side to said hot side;

said chiller unit further including a heat sink, and means for mounting said heat transfer module with said cold side in thermal communication with the beverage within said reservoir and with said hot side in thermal communication with said heat sink;

said insulation shell and said housing having upwardly open aligned gaps formed therein for receiving said dispense faucet for operative access at a front side of said housing, when said reservoir is mounted within said housing; and a trim plate carried by said dispense faucet for substantially closing said gap formed in said housing, when said reservoir is mounted therein.

21. The beverage cooler of claim 20 further including fan means for circulating air flow over said heat sink.

22. The beverage cooler of claim 21 further including filter means for filtering the air flow circulated over said heat sink by said fan means.

23. The beverage cooler of claim 20 wherein said trim plate is formed from a light transmissive material, and further including illumination means disposed within said housing, behind said trim plate.

24. The beverage cooler of claim 20 further including at least one light transmissive member mounted on said housing, and illumination means disposed within said housing, behind said at least one light transmissive member.

25. The beverage cooler of claim 24 wherein said housing includes a plurality of downwardly extending feet, said at least one generally light transmissive member comprising a plurality of light transmissive panels mounted respectively on said feet, said illumination means being disposed within said housing behind said light transmissive panels.

26. The beverage cooler of claim 20 wherein said reservoir includes a generally cylindrical lower portion merging at an upper end thereof with a relatively enlarged, generally bowl-shaped upper portion, said reservoir being removably mounted within said housing, with said bowl-shaped upper portion seated upon and substantially exposed above said housing.

27. The beverage cooler of claim 26 further seal means for substantially preventing air ingress into residual space between said insulation means and said cylindrical lower portion of said reservoir.

28. The beverage cooler of claim 26 wherein said bowl-shaped upper portion of said reservoir further includes at least one indented hand grip.

29. The beverage cooler of claim 20 further including a cap for selectively closing an upper end of said reservoir, and cap having an air filter mounted thereon.

* * * * *